United States Patent [19]

Bradley et al.

[11] 4,311,309

[45] Jan. 19, 1982

[54] TABLE TOP HOCKEY GAME

[76] Inventors: Philip E. Bradley, 2651 Point Tremble Rd., Algonac, Mich. 48001; Gordon Valentine, 18244 Woodbine, Detroit, Mich. 48219

[21] Appl. No.: 129,226

[22] Filed: Mar. 11, 1980

[51] Int. Cl.[3] ..... A63F 7/10; A63F 7/06

[52] U.S. Cl. ..... 273/85 B

[58] Field of Search ..... 273/85 R, 85 A, 85 B

[56] References Cited

U.S. PATENT DOCUMENTS

| | | | |
|---|---|---|---|
| 2,229,232 | 1/1941 | Widegren et al. | 273/85 B |
| 2,507,258 | 5/1950 | Kohler | 273/85 B |
| 2,903,264 | 9/1959 | Munro et al. | 273/85 R |
| 3,105,687 | 10/1963 | Munro et al. | 273/85 R |
| 3,647,212 | 3/1972 | Barlow et al. | 273/85 B |
| 4,146,224 | 3/1979 | Deutsch | 273/85 B X |

FOREIGN PATENT DOCUMENTS

| | | | |
|---|---|---|---|
| 543795 | 7/1957 | Canada | 273/85 A |
| 1557316 | 1/1969 | France | 273/85 B |

*Primary Examiner*—George J. Marlo

*Attorney, Agent, or Firm*—Harness, Dickey & Pierce

[57] ABSTRACT

A table top hockey game having twelve playing elements supported on a playing surface and manipulated through control rods mounted beneath the playing surface. The control rods are operative to rotate the playing elements through a shaft that extends through a slot in the playing surface. The playing surface includes twelve parallel slots, four of which are disposed between one of the goals and a side edge of the playing surface. A ball bearing, mounted on the shaft, is engageable with the slot sides to reduce the effort in moving the playing elements, and to maintain the playing element in a vertical position.

9 Claims, 4 Drawing Figures

TABLE TOP HOCKEY GAME

BACKGROUND OF THE INVENTION

This invention is related to table top hockey games, in which each playing element is mounted on a control shaft extending through a slot in the playing surface, and more particularly, to such a game in which each playing element is supported for motion on a guide rod mounted beneath the playing surface and moved by a control rod mounted between the guide rod and the playing surface, and has a ball bearing mounted on the control shaft of the playing element to engage the sides of the slot in the playing surface.

Table top hockey is a popular game. Various game apparatus have been disclosed for playing such a game. For example, U.S. Pat. No. 2,507,258 which issued to Kohler discloses a typical prior art game apparatus in which twelve playing elements are mounted on a game board, each being rotatable about an axis perpendicular to the game board, and movable along a linear path of motion by opposing players. The players advance the puck by striking it to advance it toward a goal. Each playing element is actuated by a control rod mounted beneath the playing surface and connected to the playing element by a gear box so as to permit the user to rotate the playing element as he imparts horizontal motion.

SUMMARY OF THE INVENTION

The broad purpose of the present invention is to provide improved means for manipulating a table top hockey playing element by connecting a push-pull control rod to the gear box in a position between the guide rod on which the gear box is mounted and the playing element and along the same centerline as the guide rod and the playing element, to reduce the amount of friction by the playing element control shaft contacting the sides of the slot in the playing surface, by mounting a ball bearing on the shaft.

Still further objects and advantages of the invention will become readily apparent to those skilled in the art to which the invention pertains upon reference to the following detailed descripion.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
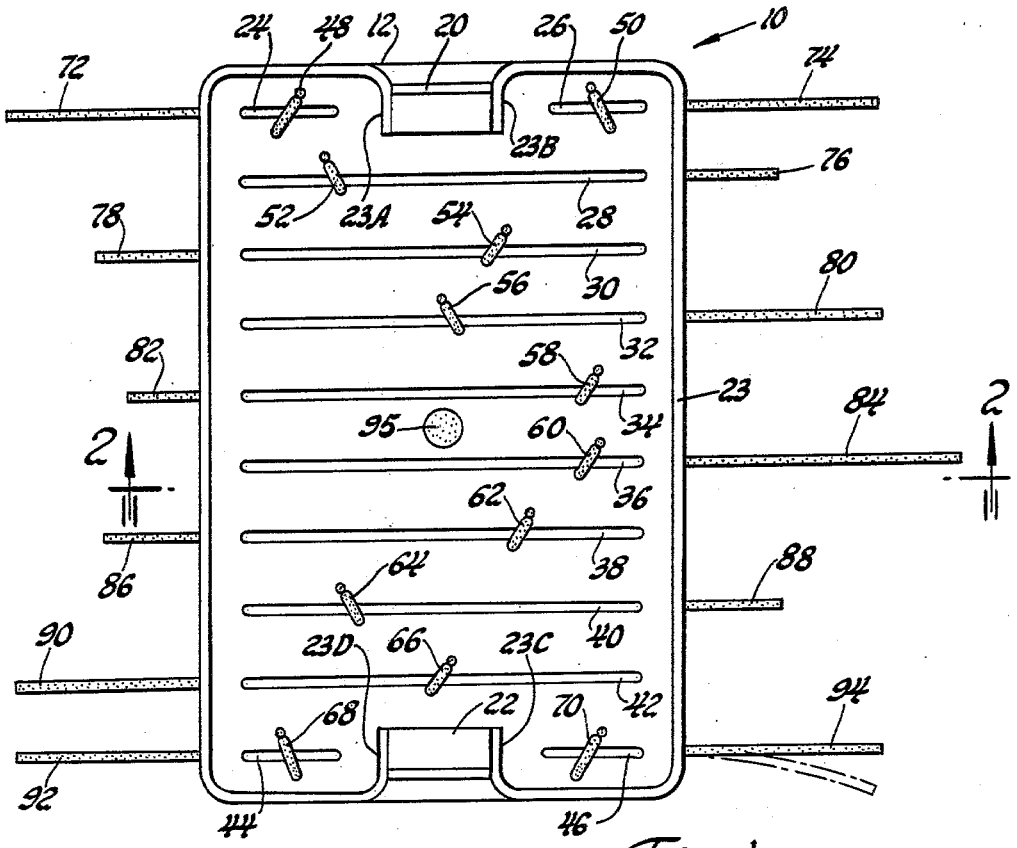
FIG. 1 is a plan view of a table top hockey game illustrating the preferred embodiment of the invention.

Referring to the drawing, a preferred game apparatus is illustrated in FIG. 1 at 10, and includes a table 12 having an upper, generally horizontal playing surface 14 supported on a pair of vertical sides 16 and 18. A pair of box-like goals 20 and 22 are mounted on playing surface 14 at opposite ends of the table.

A rail 23 is mounted on the top edge of table 12 to define the playing area. The four corners defined by the rail are rounded as illustrated in FIG. 1. The rail also forms rounded corners 23A, 23B, 23C, and 23D adjacent the goals.

The playing surface has twelve parallel slots including a pair of short slots 24 and 26 on opposite sides of goals 20, slots 28, 30, 32, 34, 36, 38, 40, and 42 each having a common length and disposed between the goals, and a second pair of short slots 44 and 46 on opposite sides of goal 22. Slots 24 and 26 are aligned with one another as are slots 44 and 46.

Twelve playing elements 48, 50, 52, 54, 56, 58, 60, 62, 64, 66, 68 and 70 are associated with slots 24 to 46, respectively. Each playing element is movable along its respective slot and is rotatable about a vertical axis.

Playing element 48 is rotatable closely adjacent corner 23A. Playing element 50 is rotatable closely adjacent corner 23B. Playing element 46 is rotatable closely adjacent corner 23D and playing element 70 is rotatable closely adjacent corner 23C.

Control rods 72, 74, 76, 78, 80, 82, 84, 86, 88, 90, 92, and 94 are connected to playing elements 48 to 70, respectively. Each control rod is so connected to its respective playing element as to move it in its slot as the control rod is either pushed or pulled, and to rotate the playing element by rotating the control rod about its longidutinal axis. Six control rods extend from opposite sides of the table to accommodate two opposing players.

Each playing element is mounted adjacent the playing surface for striking a puck 95 to move it toward one of the goals.

The relationship between playing elements 48 and 50 is such that if the puck is positioned adjacent corner 23A, playing element 48 can be rotated to strike the puck toward goal 22. Similarly, playing element 50 can be rotated to strike the puck toward goal 22 from a position adjacent corner 23B, playing element 68 can be rotated to strike the puck toward goal 20 from a position adjacent corner 23D, and playing element 70 can be rotated to drive the puck toward goal 20 from a position adjacent corner 23C. Each corner has a radius corresponding to the radius of motion of the corner playing elements.

Figure 2:
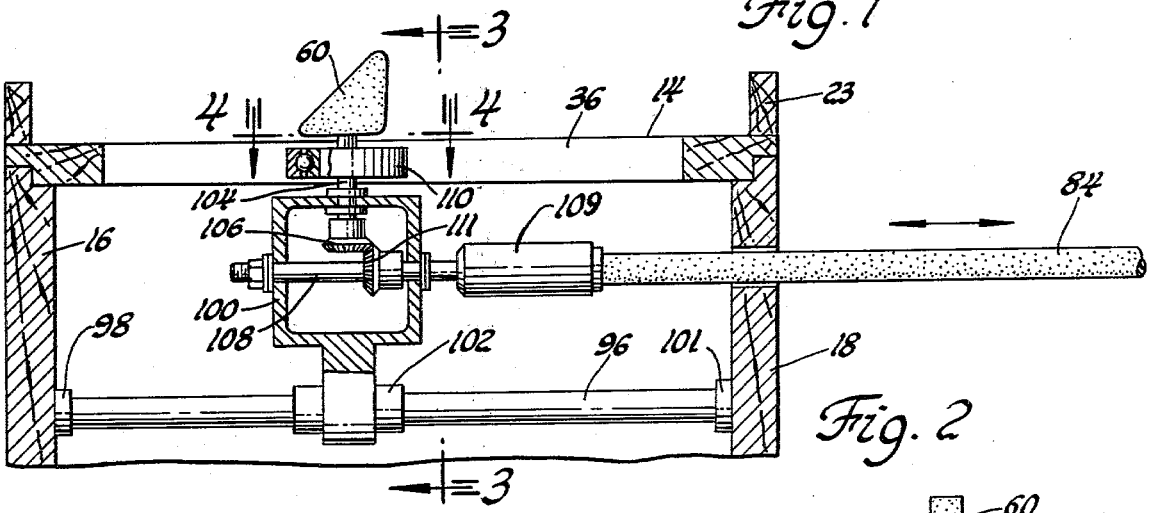
FIG. 2 is a view as seen along lines 2—2 of FIG. 1.

FIG. 2 illustrates a typical playing surface, and the manner in which it is mounted on the playing table. Guide rod 96 is mounted beneath the playing surface, its end supported in brackets 98 and 101 on opposite sides of the table. The arrangement is such that control rod 84 is disposed parallel to guide rod 96, and between the guide rod and slot 36.

A gear box housing 100 is connected to a conventional linear bearing 102 mounted on guide rod 96. Playing element 60 is mounted on a short vertical control shaft 104, and has its lower end carrying a gear 106 in gear box housing 100. Control rod 84 is connected to a short rod 108 by coupling 109. A bevel gear 111 carried on shaft 108 is meshed with gear 106 such that rotating control rod 84 about its longitudinal axis provides a rotary motion of playing element 60 about shaft 104 depending upon the direction of rotation of the control rod.

Figure 3:
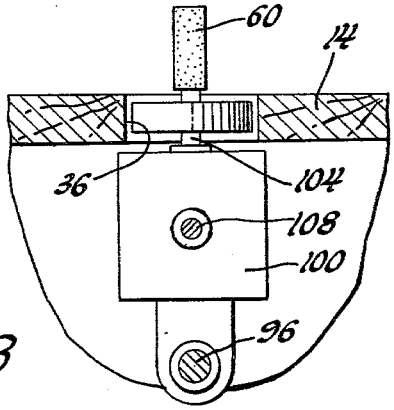
FIG. 3 is a view taken along lines 3—3 of FIG. 2.

Referring to FIG. 3, it is to be noted that control rod 84 is mounted so as to be movable along a horizontal path of motion between the playing surface 14 and guide rod 96, and has longitudinal axis intersecting the axis of rotation of shaft 104. This arrangement reduces the amount of effort necessary for the user to push or pull the control rod to provide a corresponding motion of the playing element.

Figure 4:
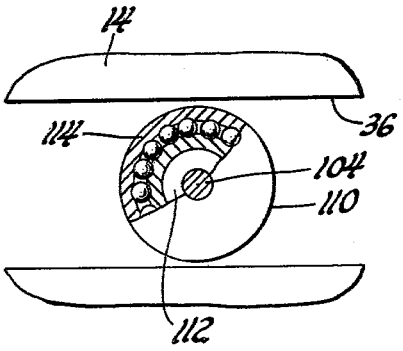
FIG. 4 is a view taken along lines 4—4 of FIG. 3.

Referring to FIGS. 3 and 4, a ball bearing 110 is mounted on shaft 104. Ball bearing 110 has an inner race 112 mounted on shaft 104, and an outer race 114 having a diameter slightly less than the distance between sidewalls of the slot 36 so as to be engageable with the slot's sidewalls as the playing element is moved along the slot. This arrangement eliminates any binding of the shaft, and also reduces the effort necessary to rotate the shaft and the playing element.

Preferably each control rod is formed of resilient plastic tubing having a length sufficient to move its respective playing element the full length of the slot in which the playing element is associated. The resilient control rods provide a safety feature if a player should accidentally bump into the control rods when they are fully extended from the table.

In use, the players move the puck toward their respective goals in accordance with the rules well known to those skilled in the art to table top hockey. A player can quickly position an appropriate playing element by moving it along its associated slot, and then rotating the playing element to strike the puck.

Having described our invention, we claim:

1. A game comprising:

a generally horizontal playing surface having opposite ends and sides;

a pair of spaced goals at opposite ends of said playing surface;

said playing surface having twelve generally parallel slots extending transversely to a line between said goals, four of said slots being disposed each between one of said goals and a side edge of said playing surface;

a control rod axially and rotatably movably mounted vertically directly beneath each slot and extending axially parallel thereto;

a playing element positioned vertically directly above each slot; and means for operatively connecting said playing element to said control rod, such that the playing element is movable along a line parallel to the associated slot and rotatably movable about an axis normal to the playing surface and intersecting said control rod in response to rotation of said control rod.

2. A gas as in claim 1 having six control rods extending beyond one side of said playing surface and six control rods extending beyond the other side of said playing surface.

3. A game as in claim 2 wherein said twelve generally parallel slots comprise eight slots disposed between said goals.

4. A game as in claim 3 wherein four control rods are associated with four nonadjacent slots of said eight slots and extend beyond one side of said playing surface and four control rods are associated with four nonadjacent slots of said eight slots and extend beyond the other side of said playing surface.

5. A game as in claim 4 wherein a guide rod is supported vertically directly beneath each slot, said guide rod extending parallel to said control rod, said means for operatively connecting said playing element to said control rod including gear means slidably connected to said guide rod.

6. A game as in claim 5 wherein said gear means is disposed between said guide rod and said slot and said control rod extends between said guide rod and said slot.

7. A game as in claim 6 wherein said means for operatively connecting said playing element to said control rod includes a shaft having one end connected to said gear means and an opposite end connected to said playing element so as to be rotatable therewith and ball bearing means disposed in said slot including an inner race and an outer race, said inner race being mounted on said shaft.

8. A game as in claim 7 wherein each of said control rods is laterally resilient.

9. A table top hockey game comprising:

a generally horizontal playing surface having opposite ends and sides, a pair of spaced goals at opposite ends of said playing surface, each of said goals having an opening for receiving a puck therein, each said opening being spaced from the associated end of said playing surface, said playing surface having twelve generally parallel slots extending transversely to a line between said goals, four of said slots being disposed each between one of said goals and a side edge of said playing surface, twelve control rods, each axially and rotatably movably mounted vertically directly beneath an associated slot and extending axially parallel thereto, six of said control rods extending beyond one side of said playing surface and six of said control rods extending beyond the other side of said playing surface.

a playing element positioned vertically directly above each slot, and means for operatively connecting said playing element to said control rod, such that the playing element is movable along a line parallel to the associated slot and rotatably movable about an axis normal to the playing surface and intersecting said control rod in response to rotation of said control rod.

* * * * *